United States Patent [19]

Siegfried

[11] Patent Number: 4,648,299

[45] Date of Patent: Mar. 10, 1987

[54] APPARATUS FOR CUTTING OFF A TEAR-OPEN STRIP

[75] Inventor: Knecht Siegfried, Gevelsberg, Fed. Rep. of Germany

[73] Assignee: Maschinenfabrik Alfred Schmermund GmbH & Co, Gevelsberg, Fed. Rep. of Germany

[21] Appl. No.: 745,604

[22] Filed: Jun. 17, 1985

[30] Foreign Application Priority Data

Jun. 23, 1984 [DE] Fed. Rep. of Germany ..... 3423295

[51] Int. Cl.[4] ..... B65B 61/18; B26D 1/30

[52] U.S. Cl. ..... 83/150; 83/202; 83/341; 83/611; 83/694

[58] Field of Search ..... 83/100, 150, 152, 304, 83/305, 317, 321, 341, 349, 602, 604, 605, 611

[56] References Cited

U.S. PATENT DOCUMENTS 3,709,077 1/1973 Trogan et al. ..... 83/152
4,244,251 1/1981 Iwao et al. ..... 83/349
4,524,658 6/1985 Focke et al. ..... 83/349 X

FOREIGN PATENT DOCUMENTS 401623 9/1909 France ..... 83/611
47-51315 12/1972 Japan ..... 83/321

*Primary Examiner*—James M. Meister
*Assistant Examiner*—John L. Knoble
*Attorney, Agent, or Firm*—Prutzman, Kalb, Chilton & Alix

[57] ABSTRACT

A tear-open strip is severed from a band of material having a width equal to the desired length of the tear-open strip by cooperation between a stationary knife-edge defining member and a pivotal knife-edge defining member. The knife edges form chords of a hyperboloid of revolution and are inclined relative to one another. The pivotal knive-edge defining member is provided with suction ports adjacent to the cutting edge whereby a severed strip may be transported by the knife to an intermittently moving sheet of packaging material to which the strip is subsequently bonded.

13 Claims, 2 Drawing Figures

APPARATUS FOR CUTTING OFF A TEAR-OPEN STRIP

BACKGROUND OF THE INVENTION (1) Field of the Invention

The present invention relates to the severing of strips from a continuous band of material and particularly to the cutting of tear-open strips from an advancing band of material and the subsequent affixation of such strips to a sheet of packaging material. More specifically, this invention is directed to the formation of narrow strips of a first material from an advancing band of that material and the subsequent placement of the thus formed strips on a sheet of a second material having a lower tear strength than the first material. Accordingly, the general objects of the present invention are to provide novel apparatus and methods of such character.

(2) Description of the Prior Art

In the formation of packages, cigarette packages for example, it is known to cut tear-open strips from a band of material and to subsequently apply such strips to a sheet of transparent packaging material. Prior art apparatus for forming such tear-open strips is exemplified by the disclosure of Federal Republic of Germany Patent Specification No. 1,586,093. In the prior art apparatus the tear open strips are severed from a band of material by cooperation between a fixed knife and a movable knife. Thus, in the apparatus of the referenced German Patent the movable knife is caused to move linearly with respect to the fixed knife with the result that the tear-open strip is essentially chopped from the band by the two knife edges. Experience has shown that this mode of cutting is undesirable in part because it has a tendency to impart distortion to the tear-open strip.

SUMMARY OF THE INVENTION

The present invention overcomes the above-briefly discussed and other deficiencies and disadvantages of the prior art by providing an improved method of and apparatus for severing ribbons or strips from continuous bands of material. Apparatus in accordance with the present invention employs cooperating fixed and movable knives having linear cutting edges which are arranged to define chords of a hyperboloid of revolution, the cutting edges of the knives being inclined relative to one another at a slight angle. The movable knife of apparatus in accordance with the invention is pivotal about a longitudinal axis through a pre-determined angle. At one limit of its pivotal motion the cutting edge of the movable knife is positioned parallel to and slightly spaced from the plane of a sheet of packaging material. The movable knife is provided with intermittently operated suction ports such that a tear-open strip severed from a band of material may be carried by the movable knife during its pivotal motion and deposited on the sheet of packaging material. Apparatus in accordance with the invention also includes means for moving the movable knife away from the stationary knife during the return portion of its pivotal motion which occurs after a severed tear-open strip has been positioned on a sheet of packaging material.

In the practice of the method of the present invention, a progressive, drawing and contactless cut is produced. The movement imparted to the pivotal knife results in its being located directly above a sheet of packaging material when it reaches its limit of travel in a first direction. Accordingly, the movable knife may function as a carrier to place a severed tear-open strip on a sheet of packaging material at the appropriate location. Subsequently, the sheet of packaging material transports the tear-open strip to a bonding device where the sheet and strip are joined.

BRIEF DESCRIPTION OF THE DRAWING

The present invention may be better understood and its numerous objects and advantages will become apparent to those skilled in the art by reference to the accompanying drawing wherein like reference numerals refer to like elements in the two FIGURES and in which.

DESCRIPTION OF THE DISCLOSED EMBODIMENT

Figure 1:
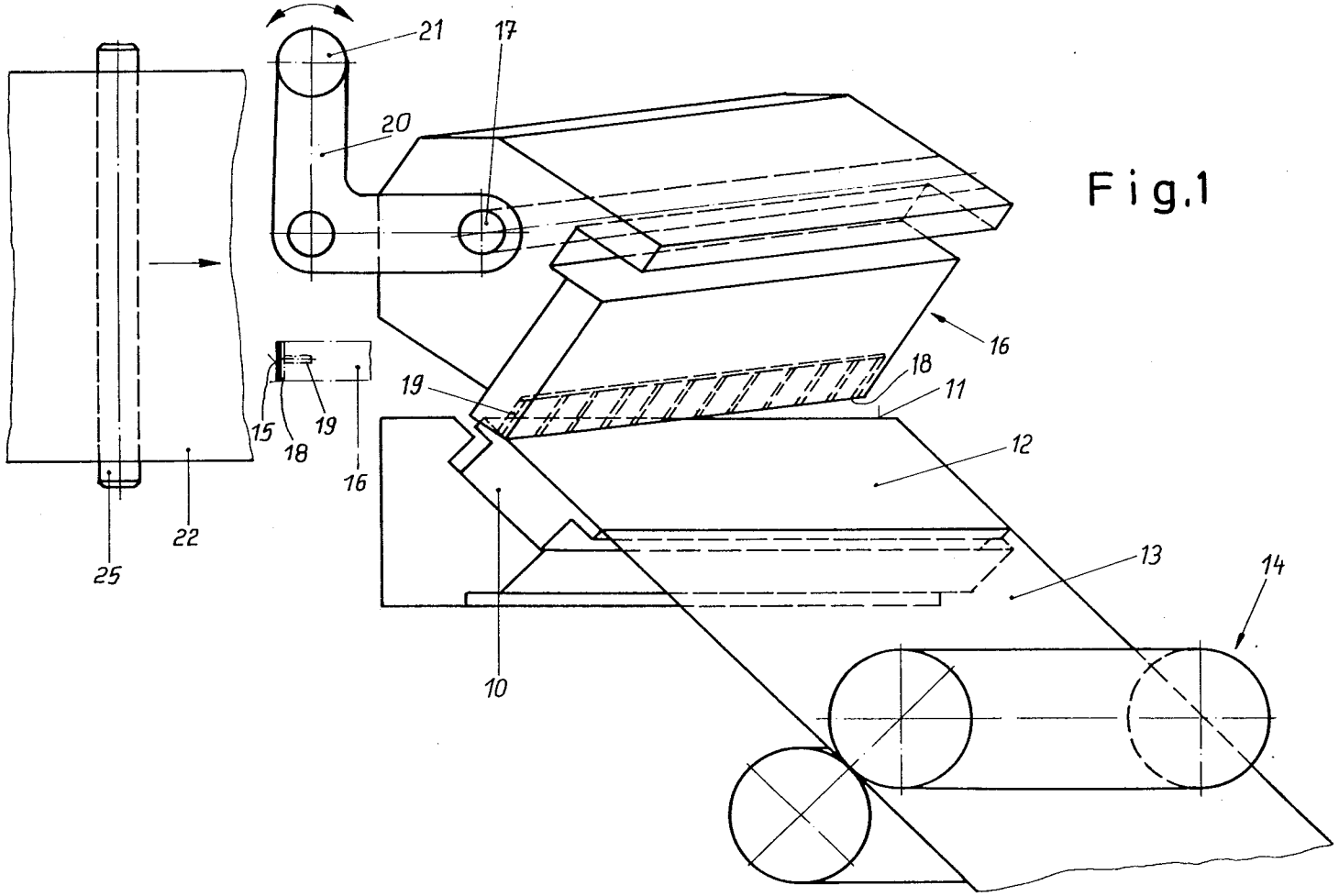
FIG. 1 is a schematic perspective view of apparatus in accordance with a first embodiment of the present invention.

With reference now to the drawing, the disclosed embodiment of apparatus for severing a tear-open strip from a band of material, and subsequently fixing that strip to a sheet of packaging material, employs a stationary knife 10 which has a cutting edge 11. Knife 10 further includes a guide and support surface 12 along which a band of material 13, from which the tear-open strips are formed, is intermittently fed by means of a conveyor device which has been indicated schematically at 14. In a preferred embodiment of the invention the support and guide surface 12 is oriented horizontally.

A movable knife, indicated generally at 16, cooperates with the statinary knife 10. Knife 18 is pivotal about an axle 17 through a pre-determined angle which is preferably in the range of 45° to 50°. The oscillatory motion of knife 16 is produced by means of a pinion, not shown, affixed to axle 17. This pinion will be engaged by a drive gear, also not shown. The movable knife 16 has a cutting edge 18. The two cutting edges 11 and 18, respectively of knives 10 and 16, are slightly inclined relative to one another and define chords of a hyperboloid of revolution. The angle of inclination between the cutting edges 11 and 18 is preferably approximately 1°. The movable knife 16 is provided, adjacent to cutting edge 18, with a plurality of suction ports which communicate with passages 19 formed in the knife body. The suction ports are located in the lower edge of knife 16 and the passages 19 are connected to a low-pressure source, not shown. Accordingly, a tear-open strip 15 severed from band 13 during the pivotal motion of knife 16 will be retained by suction against knife 16 and the knife thus performs the dual functions of cutter and carrier of the tear-open strip.

Figure 2:
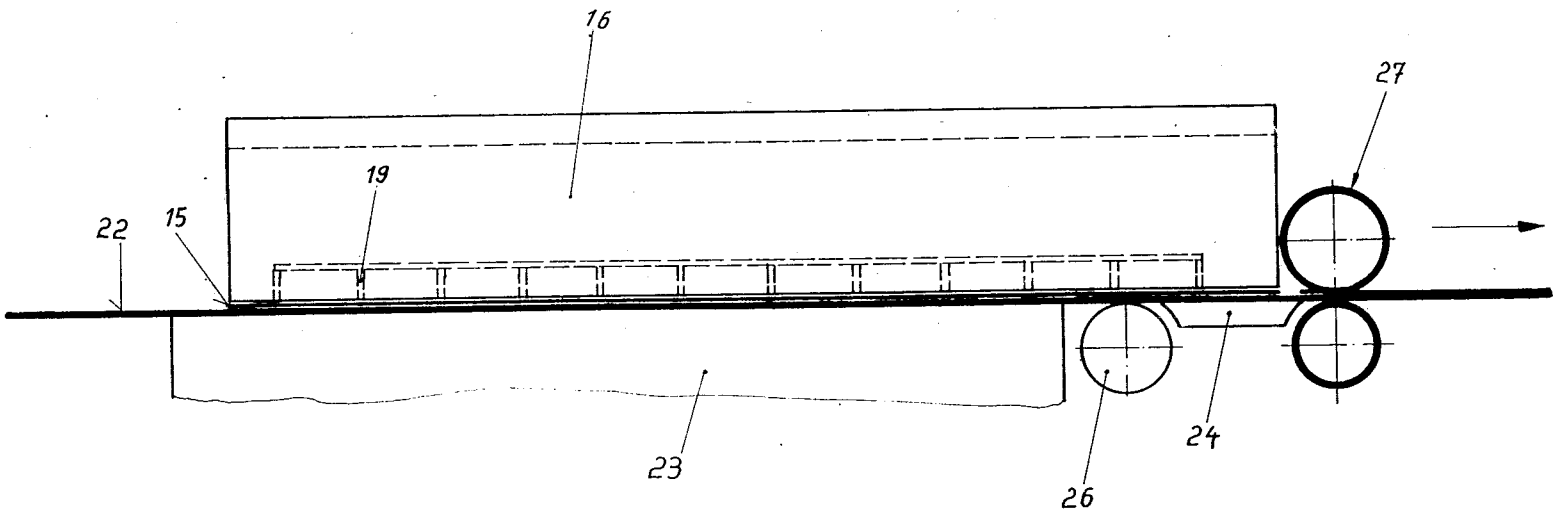
FIG. 2 is a schematic side-elevation view of a portion of the apparatus of FIG. 1.

The pivot axle 17 extend parallel to the cutting edge 18 of knife 16 and is connected, at each of its ends, to an angle lever 20, only one of which is shown. The angle levers 20 have, at the ends disposed oppositely with respect to axle 17, cam followers 21 which are preferably in the form of rollers. The cam followers 21 engage cams, not shown, which impart an oscillatory up and down motion to levers 20 and thus to knife 16. Accordingly, during that portion of its operational cycle when knife 16 is rotated back to its starting position, i.e., in the counter-clockwise direction as the apparatus is depicted in FIG. 1, the arrangement of cams and levers will cause the movable knife 16 to be lifted away from the fixed knife 10. The movement of knife 16 away from knife 10 resulting from the operation of the cams and levers may, for example, be in the range of 1/10 th mm. The pivot axle 17 is supported such that, when the movable knife 16 reaches its limit of motion in the first or cutting direction, the severed tear-open strip 15 will be supported parallel to and adjacent to the plane of a sheet of packaging material 22. The sheet of packaging material 22 is conveyed via appropriate guides 23, 24 and guide or feed rollers 25, 26 to a welding device which has been indicated schematically and generally at 27. The transport system imparts intermittent movement to the sheet of packaging material 22 so that its movements are synchronized to the rate of formation of the tear-open strips. The band of material 13 from which the tear-open strips are formed and the sheet of packaging material 22 are arranged essentially orthogonally relative to one another. However, the direction of motion of band 13 is arranged slightly obliquely relative to the longitudinal direction of movement of the sheet of packaging material 22. Thus, in the preferred embodiment, when the band 13 is conveyed in a horizontal direction, the sheet of packaging material 22 is guided so as to be directed slightly upwardly relative to the horizontal. This slight upward inclination of the plane defined by the sheet of packaging material 22 will result in the above-discussed orientation of a tear-open strip 15 being carried by movable knife 16 in a plane which is closely adjacent to and parallel with the sheet of packaging material when the movable knife 16 reaches a limit of motion in the first direction. This position is depicted in FIG. 2. With the severed tear-open strip 15 in the position of FIG. 2, the vacuum applied to suction passages 19 in knife 16 is interrupted whereupon the tear-open strip 15 is deposited on the sheet of packaging material 22. The sheet of packaging material and the tear-open strip are then transported together to the welding device 27. The operation of the device is synchronized such that there will be spaces on the sheet of packaging material between successively deposited tear-open strips 15 in the longitudinal direction of movement of the packaging material. The packaging material will be cut into individual portions in the region of these spaces. As noted above, in the practice of the present invention it has been found to be preferably to convey the band 13 in a horizontal direction and the packaging material 22 in a plane which is inclined with respect to the horizontal.

The design of the stationary and movable knives 10, 16 guarantees that a tear-open strip 15 is cut from band 13 with a progressive and drawing cut and without there being contact between the cutting edges 11, 18. As noted above, the present invention also provides means for insuring separation between cutting edges 11 and 18 when the knife 16 pivots back to its starting position subsequent to the cutting of a tear-open strip and the transporting of the severed strip to the sheet of packaging material. When a gear-type drive is employed to impart the oscillatory motion to knife 16, the movement imparted to the movable knife by the cam and lever arrangement will be selected so that the driving gear will remain engaged with the pinion which is affixed to axle 17. In the initial position of the movable knife 16, wherein its cutting edge 18 is located above the cutting edge 11 of the fixed knife 10, the band 13 is advanced by an amount corresponding to the desired width of the tear-open strip 15. Subsequently, as a result of the rotation of the movable knife 16, a tear-open strip 15 is progressively severed from the band 13 and retained against the movable knife 16 by means of suction whereby the severed tear-open strip may be transferred onto the sheet of packaging material 22 by knife 16.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An apparatus for severing a tear-open strip from a band of material with a width equal to the length of said strip and for applying said strip to an intermittently conveyed web of packaging material which extends substantially transversely relative to said band comprising:

two knife means for cooperatively cutting a said strip from a said band, said knife means each being provided with a cutting edge, one of said knife means being stationary and housing a support and guide surface for said band and the other of said knife means having a longitudinal axis and being movable with respect to said stationary knife means for severing said strip from said band, said other knife means having openings in a surface adjacent to its cutting edge, said openings being subjected to suction for holding and transporting said severed strip, wherein said cutting edges of said knife means form chords of a hyperboloid of revolution and are inclined relative to each other to provide a drawing-type cutting of said strip from said band;

means for pivoting said movable knife means through a predetermined angle about a longitudinal axis of said movable knife means, said longitudinal axis being arranged such that at one end position of pivot of the movable knife means said surface having said openings is in the plane of said web, and at the other end position of pivot said movable knife means presents a cutting edge inclined relative to the cutting edge of the stationary knife means for cooperating therewith to begin the draw-down severing of said strip; and means for displacing said movable knife means during its travel from the first end position to the other end position so that said cutting edges are out of engagement during said travel.

2. The apparatus of claim 1 wherein said movable knife means is pivoted through an angle in the range of 45° to 50°.

3. The apparatus of claim 1 wherein the angle of inclination between said knife edges is approximately 1°.

4. The apparatus of claim 2 wherein the angle of inclination between said knife edges is approximately 1°.

5. The apparatrus of claim 1 wherein said stationary knife means guide the band of material along the horizontal plane to the edge of said stationary knife means and wherein said sheet of packaging material is guided so as to define a plane which is inclined to the direction of motion of the packaging material relative to horizontal.

6. The apparatus of claim 2 wherein said stationary knife means guides the band of material along a horizontal plane to the edge of said stationary knife means and wherein said sheet of packaging material is guided so as to define a plane which is inclined in the direction of motion of the packaging material relative to horizontal.

7. The apparatus of claim 3 wherein said stationary knife means guides the band of material along the horizontal plane to the edge of said stationary knife means and wherein said sheet of packaging material is guided so as to define a plane which is inclined to the direction of motion of the packaging material relative to horizontal.

8. The apparatus of claim 4 wherein said stationary knife means guides the band of material along a horizontal plane to the edge of said stationary knife means and wherein said sheet of packaging material is guided so as to define a planee which is inclined in the direction of motion of the packaging material relative to horizontal.

9. The apparatus of claim 1 wherein said movable knife means includes a pivot axis and said means for displacing said movable knife means relative to said stationary knife means comprises lever means engaging said pivot axle at opposite sides of said movable knife means at first ends of said lever means, and cam means for imparting motion to the second end of said lever means, the operation of said cam means being synchronized with the pivotal motion of said movable knife means.

10. The apparatus of claim 8 wherein said movable knife means includes a pivot axle and asid means for displacing said movable knife means relative to said stationary knife means compriss lever meeans engaging said axle at opposite sides of said movable knife means at first ends of said lever means, and cam means for imparting motion to the second ends of said lever means, the operation of said cam means being synchronized with the pivotal motion of said movable knife means.

11. The apparatus of claim 3 wherein said movable knife means includes a pivot axle and said means for displacing said movable knife means relative to said stationary knife means comprises lever means engaging said axle at opposite sides of saaid movable knife means at first ends of said lever means, and cam means for imparting motion to the second ends of said lever means, the operation of said cam means being synchronized with the pivotal motion of said movable knife means.

12. The apparatus of claim 5 wherein said movable knife means includes a pivot axle and said means for displacing said movable knife means relative to said stationary knife means comprises lever means engaging said axle at opposite sides of said movable knife means at first ends of said lever means, and cam means for imparting motion to the second ends of said lever means, the operation of said cam means being synchronized with the pivotal motion of said movable knife means.

13. The apparatus of claim 8 wherein said movable knife means includes a pivot axle and said means for displacing said movable knife means relative to said stationary knife means comprises lever means engaging said axle at opposite sides of said movable knife means at first ends of said lever means, and cam means for imparting motion to the second ends of said lever means, the operation of said cam means being synchronized with the pivotal motion of said movable knife means.

* * * * *